US006918524B1

(12) United States Patent
Mochizuki et al.

(10) Patent No.: US 6,918,524 B1
(45) Date of Patent: Jul. 19, 2005

(54) STAPLE ATTRACTING MEMBER FOR ATTRACTING JAMMED STAPLES

(75) Inventors: Naoto Mochizuki, Yamanashi-ken (JP); Toshiro Fukasawa, Yamanashi-ken (JP)

(73) Assignees: ACCO Brands, Inc., Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/362,154

(22) PCT Filed: Aug. 31, 2001

(86) PCT No.: PCT/IB01/01600

§ 371 (c)(1),
(2), (4) Date: Feb. 19, 2003

(87) PCT Pub. No.: WO02/18110

PCT Pub. Date: Mar. 7, 2002

(51) Int. Cl.[7] ..... B27F 7/11

(52) U.S. Cl. ..... 227/113; 227/156

(58) Field of Search ..... 227/113, 120, 135, 227/136, 155, 156

(56) References Cited

U.S. PATENT DOCUMENTS

| | | | | |
|---|---|---|---|---|
| 3,640,443 | A | 2/1972 | Itagaki | |
| 4,491,261 | A * | 1/1985 | Mitsuhashi | 227/76 |
| 4,616,774 | A * | 10/1986 | Yasuda | 227/113 |
| 4,619,392 | A | 10/1986 | Won | |
| 4,623,082 | A * | 11/1986 | Kurosawa | 227/7 |
| 4,640,451 | A * | 2/1987 | Steiner et al. | 227/76 |
| 4,650,105 | A * | 3/1987 | Kihara | 227/120 |
| 5,029,745 | A * | 7/1991 | Akizawa et al. | 227/155 |
| 5,221,036 | A * | 6/1993 | Takase | 227/19 |
| 5,690,268 | A * | 11/1997 | Evans et al. | 227/156 |
| 6,062,456 | A | 5/2000 | Patti et al. | |
| 6,484,921 | B2 * | 11/2002 | Hakozaki et al. | 227/2 |

* cited by examiner

*Primary Examiner*—Louis Huynh
*Assistant Examiner*—Nathaniel Chukwurah
(74) *Attorney, Agent, or Firm*—Michael Best & Friedrich LLP

(57) ABSTRACT

A staple storage unit (10/20) allows the effective and easy removal of jammed staples (200) from the inside of the apparatus (100) by attracting jammed staples to the staple storage unit. The staple storage unit can be removed from the stapler apparatus frame. The staple storage unit is detachably mounted to a stapler apparatus provided with a storage unit (10) storing staples and a guide unit (20) to guide staples in this storage unit to a staple driving unit (103). The stapler includes staple attracting member (24) in the apex of a staple driving unit on the guide unit (20).

9 Claims, 14 Drawing Sheets

STAPLE ATTRACTING MEMBER FOR ATTRACTING JAMMED STAPLES

BACKGROUND OF THE INVENTION

This invention relates to a staple storage unit that is detachable from a stapler main body and guides staples to a staple driver, and a stapler device that comprises this staple storage unit.

Conventionally, a stapler unit separates staples attached to each other in roll form or sheet form one by one by means of a driver means, and drives these staples into sheets or the like. Generally, these staples are formed from a soft magnetic material such as steel or the like. When these staples are driven by the driver means, the driver means is configured such that it moves slightly greater than the thickness of one staple in a driver path that is demarcated by a face plate and a rear plate, and drives a staple into sheets and the like. For example, this configuration is shown in FIG. 19 of Japanese Published Patent Application H9-155762.

When this device drives a staple by means of the driver means, because it drives the staple via a relatively narrow driver path, there are times when staple jams occur in this driver path when thick sheets are used and when proper driving takes place. For this reason, in the device shown in the aforementioned Japanese Published Patent Application H9-155762 and the like, the driver path is integrally formed with the staple driver unit (a detachable unit for a staple cartridge detachable and the like), and when staple jams are generated, this staple storage unit is detached from the stapler device unit and the jammed staple is removed.

Note that in a similar device shown in Japanese Published Patent Application H11-254348, it shows that after the staple storage unit is removed, the face plate is opened and the jammed staple is removed.

SUMMARY OF THE INVENTION

However, when the staple storage unit is detached from the stapler device frame, there are times when jammed staples will not only undoubtedly remain in the staple storage unit, but fall down inside the device and remain in the device.

In particular, when a stapler device is incorporated in an image forming device or a post-processing device of an image forming device, it is thought that a jammed staple remaining therein will, for example, be conveyed together with a sheet, enter into other mechanisms, and produce secondary failures to these mechanisms.

Moreover, in the process of detaching the staple storage unit from the device frame, a jammed staple will fall into the device due to operator handling. This is a problem because this process cannot be performed easily, and it does not have a good effect on the environment.

In order to solve the above mentioned problems, an object of the present invention is to provide a staple storage unit and a stapler device comprising the same that can attract staples jammed in a staple storage unit capable of being pulled out from a stapler device, and in which jammed staples can be reliably and easily be removed from inside the device.

A staple storage unit of this invention comprises a storage portion that stores staples and a guide portion that guides staples in this storage portion to a staple driver, is detachable from a stapler device frame, and has a staple attracting material on the front of the staple driver side of the aforementioned guide portion.

The aforementioned staple attracting material of the staple storage unit of this invention is comprised of an adhesive.

The aforementioned staple attracting material of the staple storage unit of this invention is comprised of a magnetic material.

Thus, a jammed staple in the staple driver can be easily taken out of the device and eliminated.

A staple storage unit of this invention is comprised of a storage portion that stores staples and a guide portion that guides staples in this storage portion to a staple driver having a driver means capable of reciprocating that drives the staples, is detachable from a stapler device frame, a guide surface is formed on least one portion of this staple storage unit and guides the movement of staples to be driven by means of the aforementioned driver means, and a magnetic material is disposed on this guide surface.

The aforementioned guide surface of the staple storage unit of this invention is formed from a non-magnetic material that covers the magnetic material.

The aforementioned magnetic material of the staple storage unit of this invention is disposed in a crown movement area of a staple to be driven by means of the driver means.

Thus, jammed staples in the staple driver can be reliably and easily taken out of the device and eliminated. Moreover, the staples to be driven are prevented from contacting the magnetic material by covering the magnetic material with a non-magnetic material such as stainless steel or the like, and thus increasing the durability of the magnet. In addition, covering a magnet with a non-magnetic body is more efficient than attracting a staple formed from a magnetic material with magnetic force.

In the staple storage unit or the stapler device of this invention, the staple storage unit is formed from a cartridge that stores staples and a cartridge holder that detachably supports this cartridge.

Thus, when changing a cartridge due to normal staple consumption only the cartridge to be taken out. When a jam occurs in the staple driver, the cartridge holder can be taken out and the jam can be eliminated. In this case as well, jammed staples can be easily taken out of the device and eliminated.

A stapler device of this invention detachably supports a staple storage unit having a storage portion that stores staples and a guide portion that guides staples in this storage portion to a staple driver, and the staple drive unit comprises a staple attracting material on the front of the staple driver side of aforementioned guide portion.

The aforementioned staple attracting material of the stapler device of this invention is composed of a magnetic material.

Thus, jammed staples in the staple driver can be reliably and easily taken out of the device and eliminated.

According to the above inventions, a staple storage unit or a stapler device comprised of the same can be provided that attracts jammed staples in a staple storage unit capable of being pulled out from a stapler device frame by means of an adhesive or a magnetic material, and the jammed staples can reliably and easily taken out of the device and eliminated.

Below, an embodiment of a stapler according to the present invention will be described in accordance with the figures.

DESCRIPTION OF THE REFERENCE NUMERALS

Figure 1:
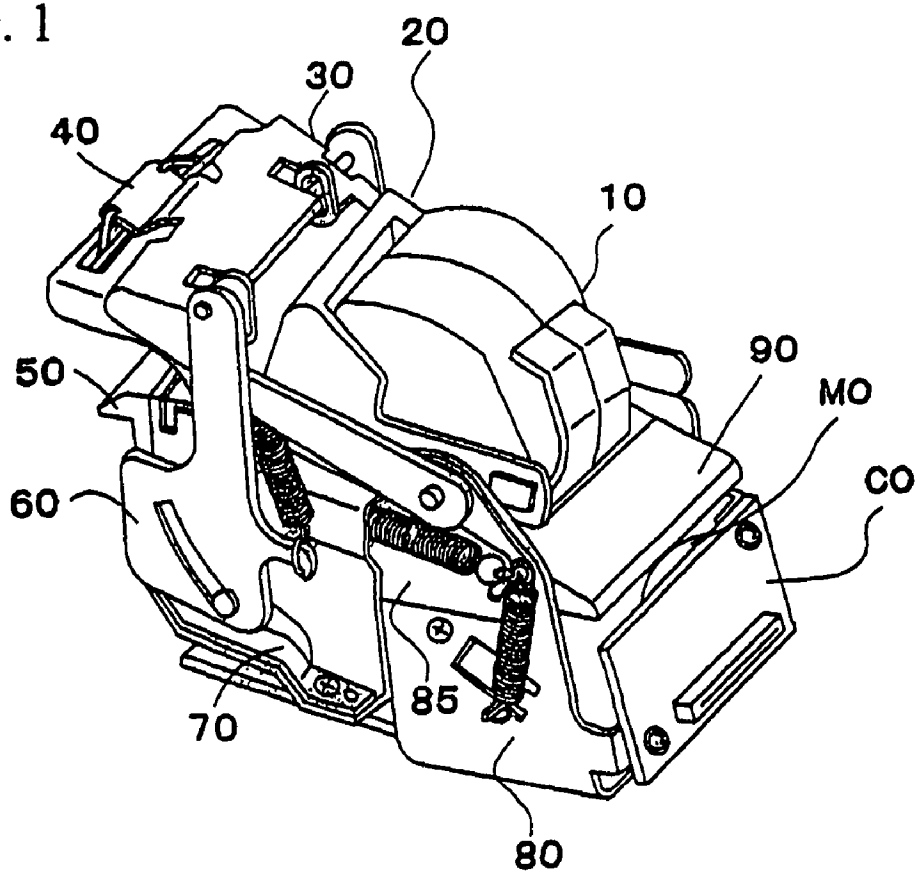
FIG. 1 is a plan view of a stapler according to the present invention.

10 Staple cartridge
20 Cartridge holder
30 Anvil unit
40 Clincher
50 Paper guide unit
60 Joint lever
70 Paper thickness absorption leaf spring
80 Main body frame
90 Set lever
MO Motor
CO Connector base
SE No staples/cartridge installation detection sensor
HP Stapler home position sensor detector

DETAILED DESCRIPTION

FIG. 1 shows a plan view of a stapler device, in which 10 is a staple cartridge (storage portion), 20 is a cartridge holder (guide portion), 30 is an anvil unit, 40 is a clincher, 50 is a paper guide unit, 60 is a joint lever, 70 is a paper thickness absorbing leaf spring, 80 is a main body frame, 90 is a set lever, MO is a motor, and CO is a connector base. Note that the staple cartridge (storage portion) 10 and the cartridge holder (guide portion) 20 are the staple storage unit.

Figure 2:
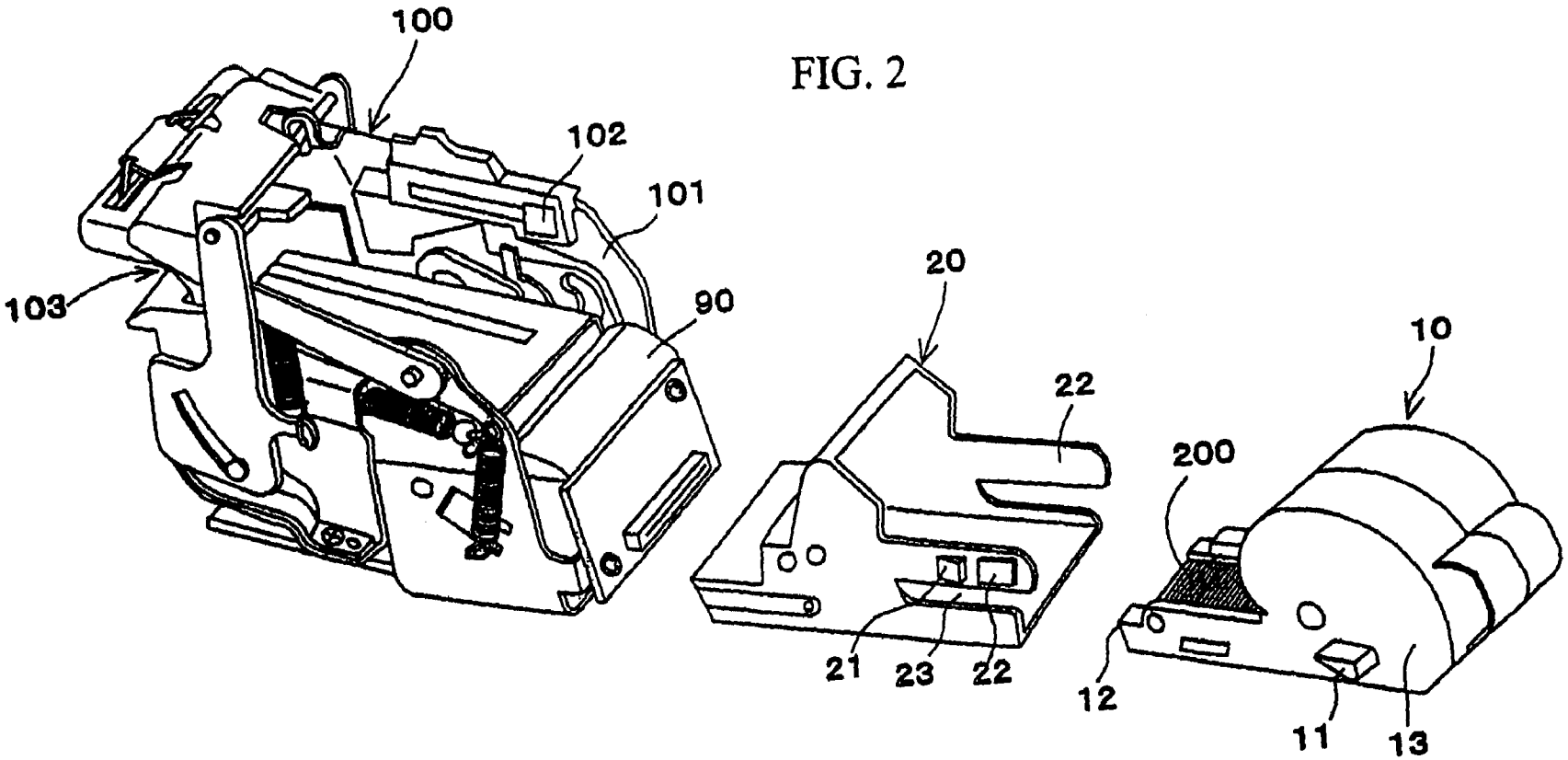
FIG. 2 is a partially exploded plan view of a staple replenishment mechanism of the same stapler device.
Figure 11:
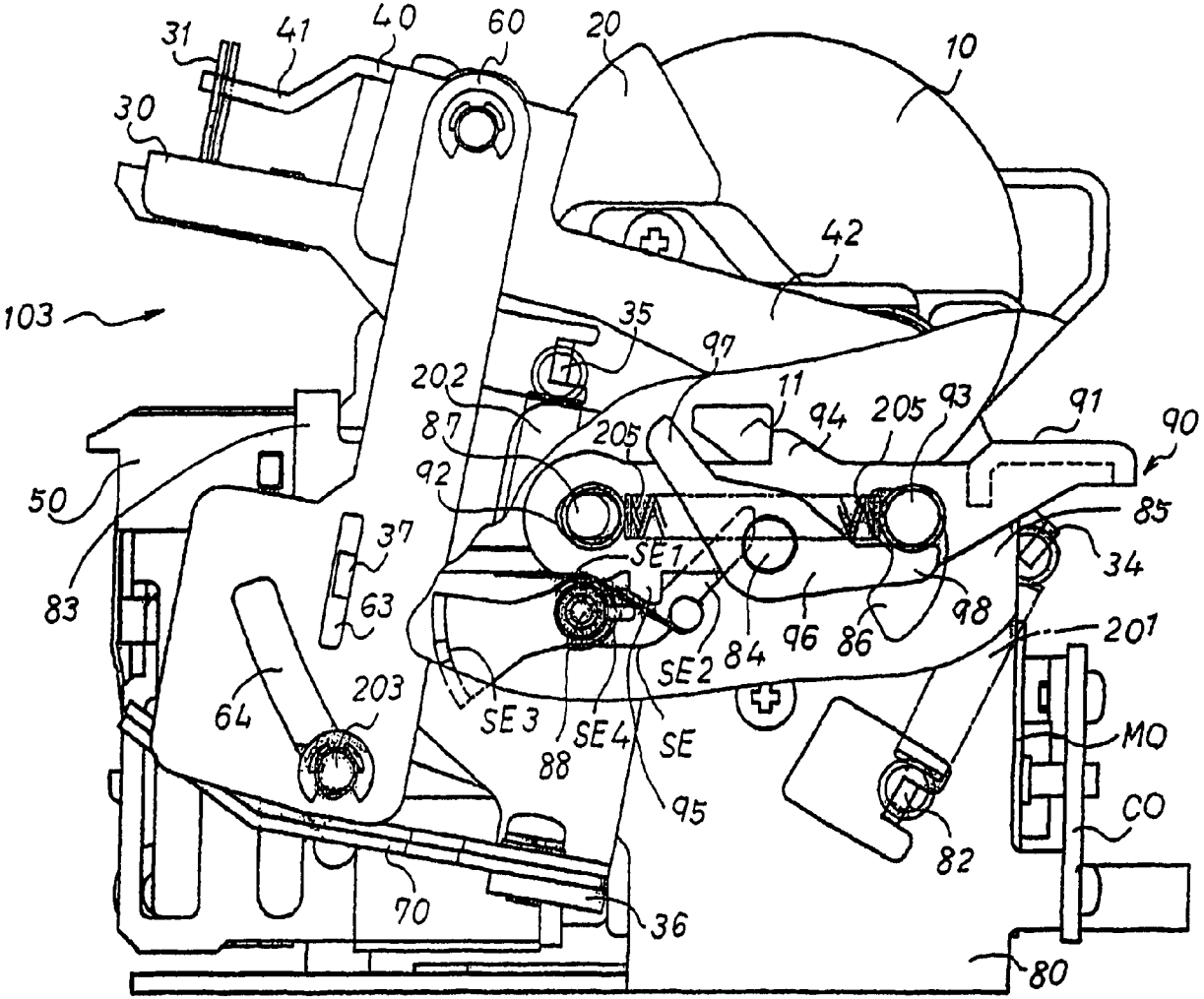
FIG. 11 is a partial cross-sectional view of the required parts that describe the state in which the set lever has locked the cartridge in the same stapler device.
Figure 12:
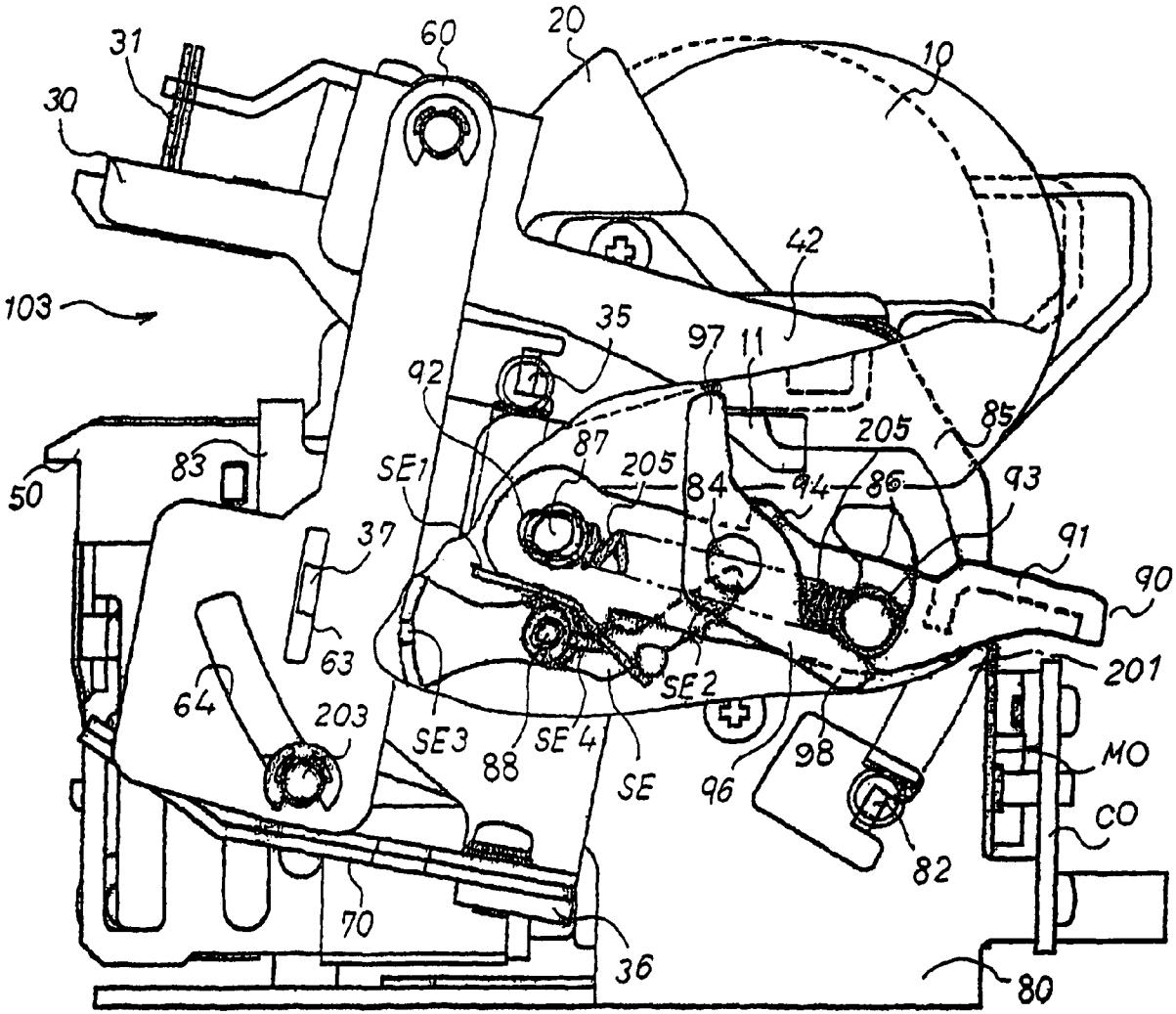
FIG. 12 is a partial cross-sectional view of the required parts that describe the state in which the set lever has released the cartridge lock in the same stapler device.

FIG. 2 is a partially exploded plan view for describing a staple replenishing mechanism of the same stapler device, which comprises a stapler device main body 100, a cartridge holder 20, and a cartridge 10. As the set lever 90 is held down in an installation position, installation knobs 22 on the left and right sides of the cartridge holder 20 are first pinched together, and the cartridge holder 20 is guided by an installation guide 101 of the stapler main body 100 and installed therein. Detents 21 on the cartridge holder 20 are retained in catch holes 102 on the stapler main device 100. By guiding guide protrusions 11 on the cartridge 10 along installation guides 23 in the cartridge holder 20 and inserting staple end 12 in this state, as will be described later in FIG. 11, the guide protrusions 11 on cartridge 10 engage with a interlock lever 96 that releases a set lever by pushing it in, and thus the set lever 90 is released from its locked state. By engaging the set lever 90 while pushing the guide protrusions 11 on the cartridge 10 toward a staple driver 103 from the rear, the cartridge holder 20 and the cartridge 10 are retained in a state in which they are constantly urged toward the staple driver 103 of the stapler main body 100. Note that in the case of the staple replenishing mechanism, in order to try to make installation possible in the state in which the installation knobs 22 on the cartridge holder 20 are pinched inward, an installation procedure has been selected so that the cartridge holder 20 cannot be installed in the stapler device main body 100 when the cartridge 10 is inserted in the cartridge holder 20, and the cartridge holder 20 has been designed so that it cannot be easily detached from the stapler device main body 100. Further, the method of urging the aforementioned cartridge holder 20 and the cartridge 10, and the method of locking by means of the set lever 90, will be described in detail in the operational description of FIGS. 11 and 12 provided below. Note also the cartridge 10 stores staples 20 in a storage unit 13 therein, the staples 20 being straight, long and slender and grouped together side to side, linked together into a belt by means of an adhesive, and wound up into a roll. The staple end is prevented from returning back into the storage unit 13 by means of a staple non-return pawl not shown in the figures, and that end of the staples is stored in a state in which it abuts and is positioned on the tip portion 12 of the cartridge 10.

Figure 3:
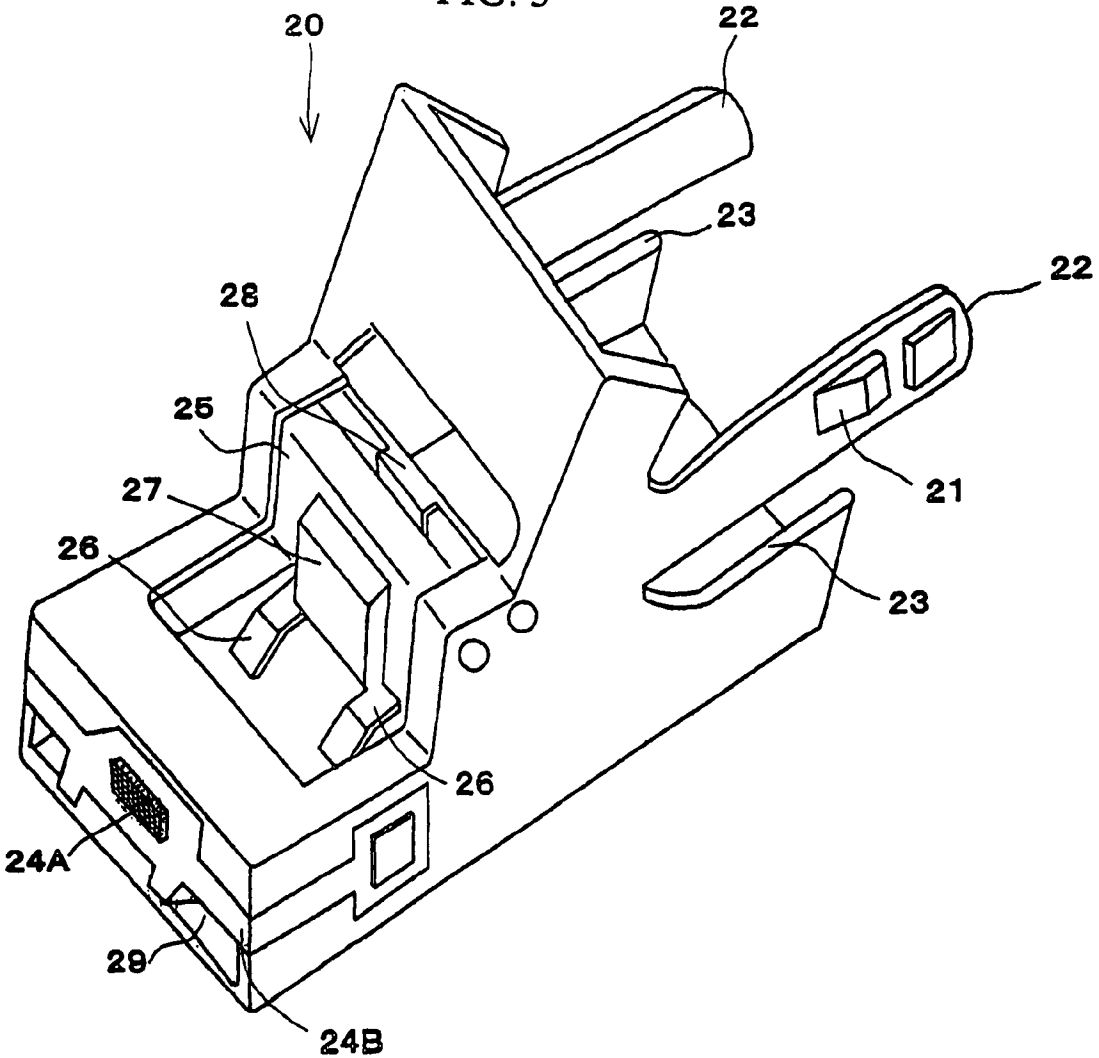
FIG. 3 is a plan view of a cartridge holder of the same stapler device.

FIG. 3 is a plan view of the cartridge holder of the same stapler device which, other than the detent 21, the installation knobs 22, and the installation guides 23, comprises a magnet 24A that is disposed such that it faces a position that a crank portion passes through which joins both ends of a staple that has been formed into a U-shape and driven into a stack of sheets, and that serves to eliminate unsatisfactorily bound staples from the device that are generated during the stapling process in the front of the stapler main body 100 (in the installation direction) by detaching the cartridge holder 20. The cartridge holder 20 further comprises a non-magnetic magnet retaining member 24B made of stainless steel and formed into a U-shape such that it holds a front portion of the magnet 24A, the front portion thereof becoming a guide surface when a driver on the cartridge holder 20 slides, and a staple forwarding pawl means 25 that has a staple forwarding pawl 26 that steps the staples in the cartridge 10 to a stapling position one by one and is pivotably supported on the lateral surfaces of the cartridge holder 20 at a forward pivot portion, and an engaging portion 27 that engages with protrusions on the clincher 40. The cartridge holder 20 also comprises a step pressing spring 28 that urges the staple forwarding means 25 in a stepped manner, and a hole 29 from which the staple tip portion 12 of the cartridge 10 projects. The process by which an unsatisfactory staple is removed from the stapler device when it is stuck between the stapler device main body 100 and the cartridge holder 20 will now be described. First, in the state shown in FIG. 1, by using one hand to push the set lever 90 downward, as described in detail in FIGS. 11 and 12 below, the lock on the cartridge 10 is released, the cartridge 10 is pushed out of the device, and the cartridge is then pulled out. Next, as shown in FIG. 2, the installation knobs 22 on the cartridge holder 20 are pinched together, and by pulling out the cartridge holder 20 from the stapler device main body 100 in the state in which its engagement is released from the engagement holes 102 in the stapler device main body 100, the space between the stapler device main body 100 and the cartridge holder 20 is open. Because the staples that are jammed in this space are generally made of steel wire about 0.5 mm in cross-section, are cut into 25 mm lengths, are grouped together side to side and linked together into a belt by means of a synthetic resin type of adhesive, they are easily attracted to the magnet 24A. In this situation, because the staples have almost no weight and are easily attracted to the magnet 24A provided on the front portion of the cartridge holder 20, a flux density of 40 Gauss is sufficient. By pulling the cartridge holder 20 out of the stapler device main body 100, one can widen the space between the stapler device main body 100 and the cartridge 20 in which the jammed staple is sandwiched, jammed staples can be attracted to the magnet 24A, and can be taken out of the device while the cartridge holder 20 is pulled out of the stapler device main body 100. Note that in this embodiment, the magnetic attraction force of the magnet 24A is used. However, by pulling the cartridge holder. 20 out of the stapler device main body 100, jammed staples can be taken out therefrom, and instead of using the magnetic attraction force of the magnet 24A, the same effect can be easily obtained by replacing the magnet 24A or the staple facing portion of the magnet retaining member 24B with an adhesive such as adhesive tape. In addition, the magnet 24A or the staple attracting agent such as an adhesive or the like are attached to the cartridge holder 20 in this embodiment. However, even in a staple storage unit in which the cartridge 10 and the cartridge holder 20 are formed integral with each other, this can be attained by arranging it in a position that corresponds to the front portion of the cartridge holder 20 in which the magnet 24A is attached.

Figure 4:
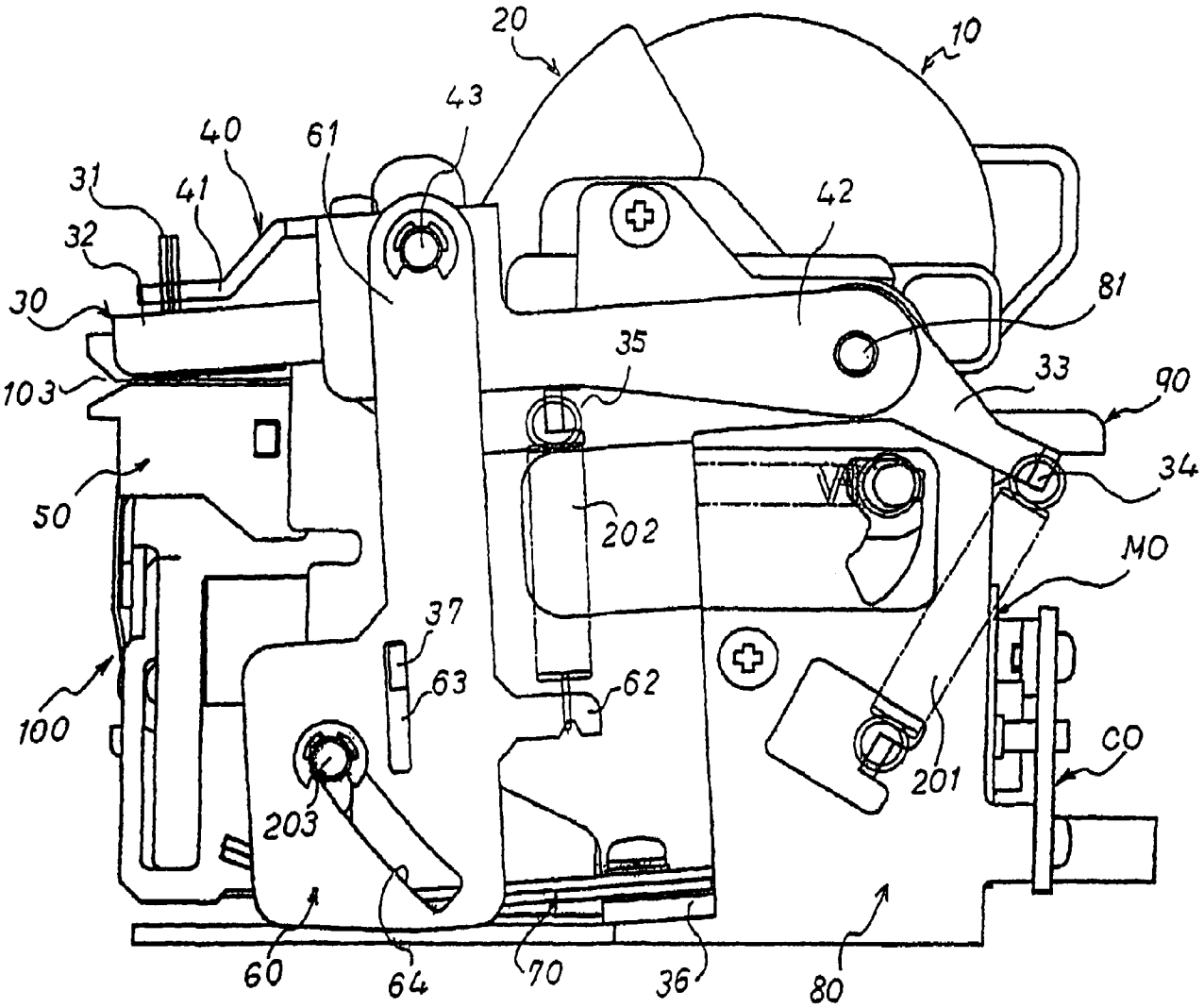
FIG. 4 is a lateral view of the same stapler device.
Figure 5:
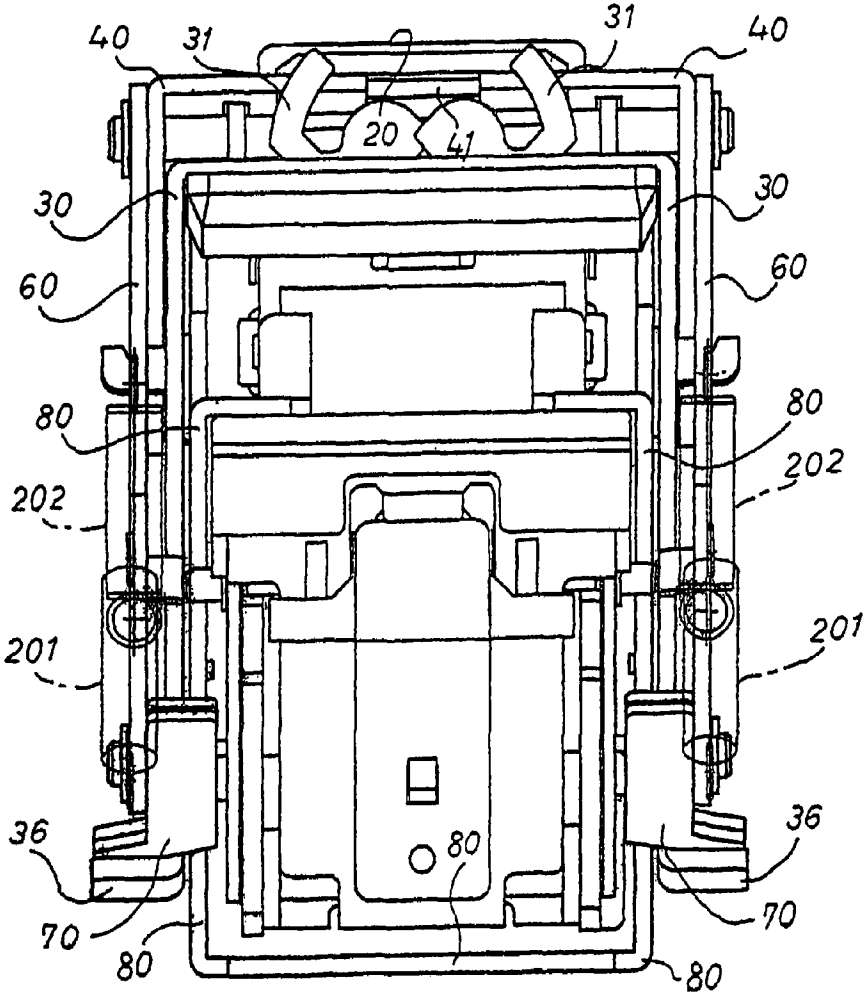
FIG. 5 is a front view of the same stapler device.
Figure 6:
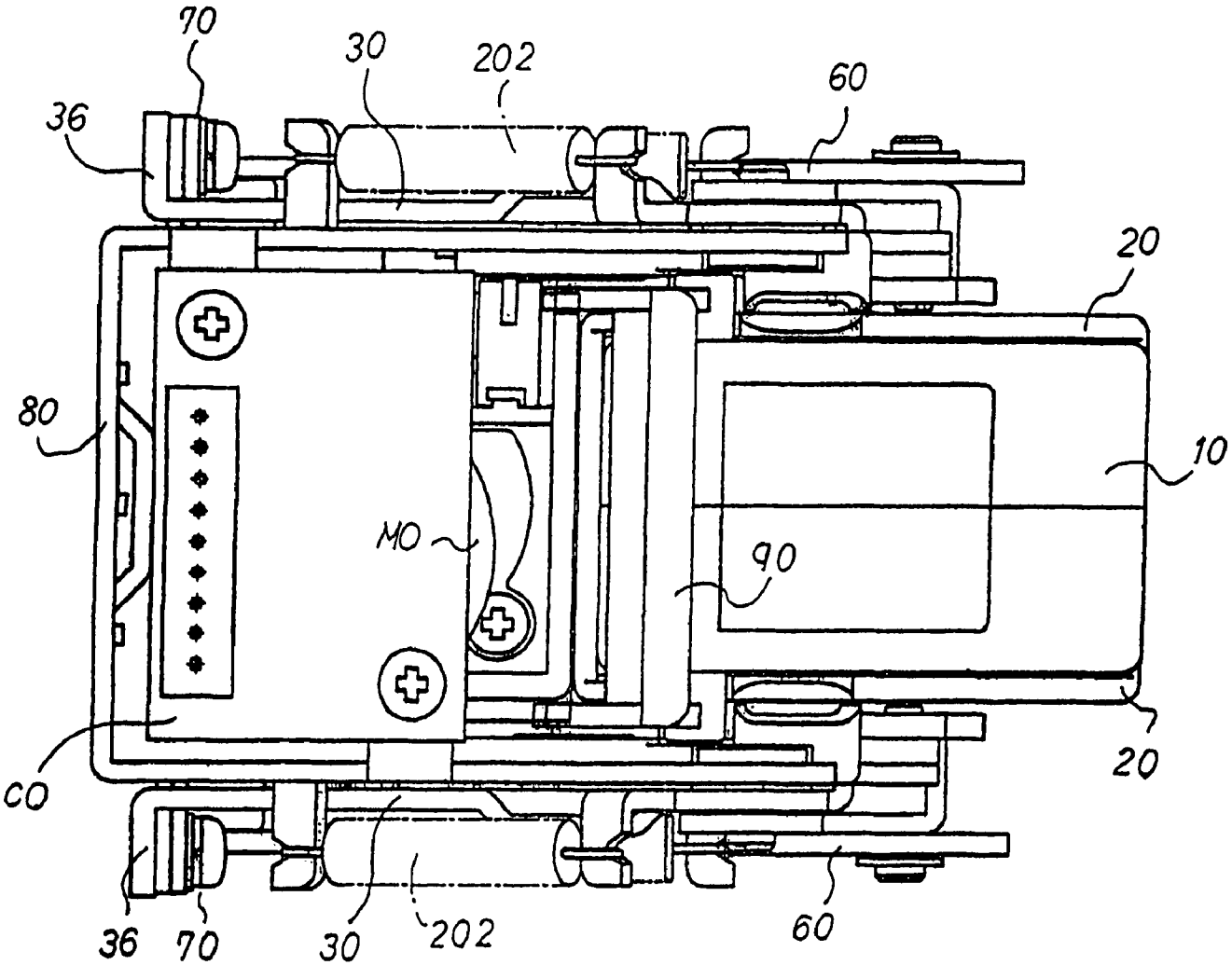
FIG. 6 is a bottom view of the same stapler device.
Figure 7:
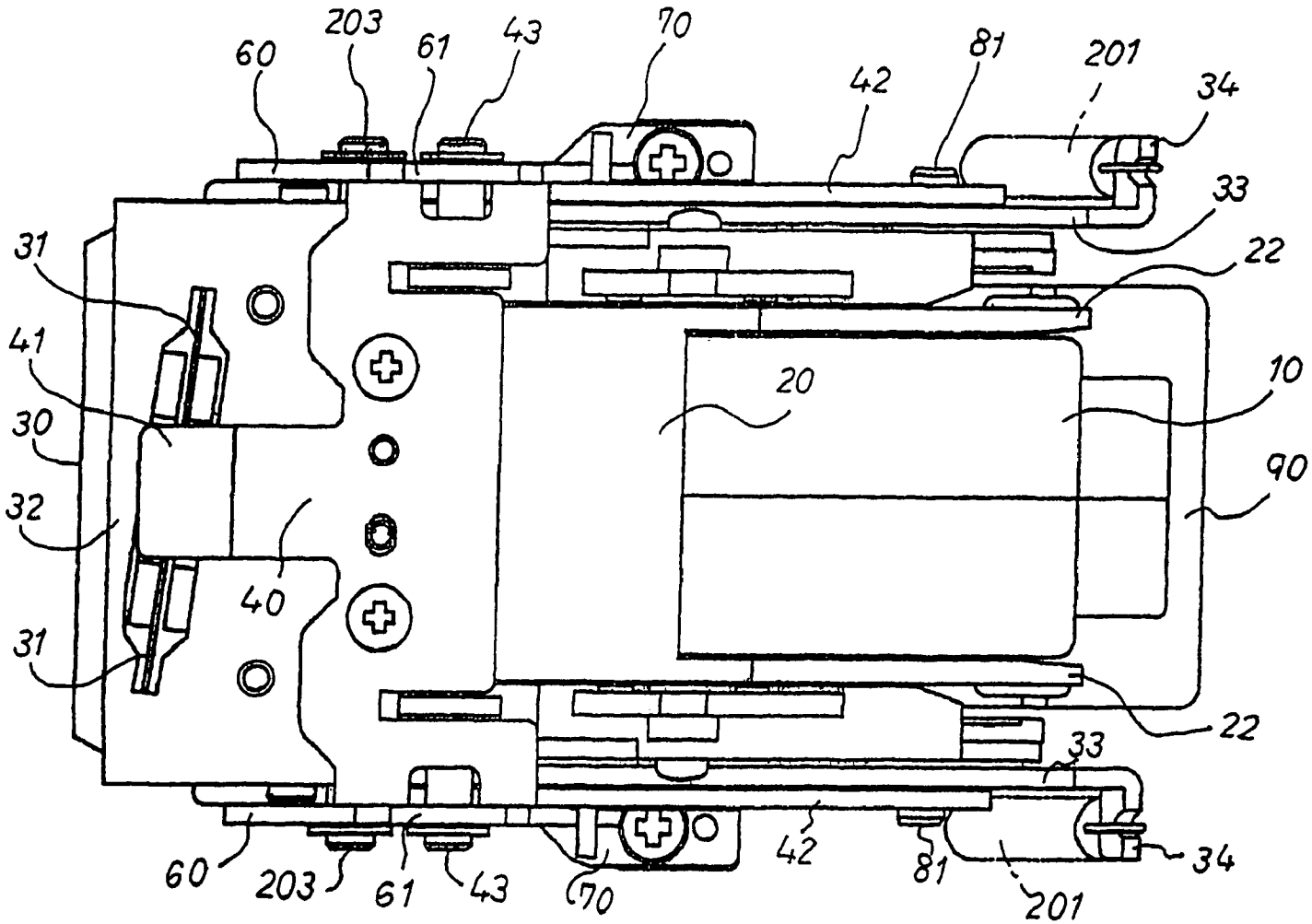
FIG. 7 is an upper view of the same stapler device.

FIG. 4 is a lateral view of the same stapler device, FIG. 5 is a front view of the same stapler device, FIG. 6 is a rear view of the same stapler device, and FIG. 7 is a view of the top of the same stapler device. The configuration of the components will now be described in accordance with FIGS. 4 to 7.

As shown in FIG. 2, cartridge 10 is snail-shaped, and has guide protrusions 11, a storage section 13 that is a stapler case having a symmetrical shape from left to right and that can be split into two section from left to right, and stores staples 200 that are staple sheets linked together into a belt and wound up into a roll, and a staple reverse prevention pawl 14 (shown in FIG. 9) that engages the front staple of the staples 200 such that it prevents it from returning back into the storage unit 13.

The cartridge holder 20 serves to hold the cartridge 10. However, a description thereof will be omitted because it was described in detail earlier in FIG. 3.

As shown in FIG. 5, the anvil unit 30 is an open U-shaped member in which the lower side thereof covers the top of the paper guide unit 50 disposed below it. The anvil unit 30 includes clincher arms 31 that pivot about a front pivot portion 32 overlooking the staple driver 103 and which are respectively synchronous in the backward direction therewith, and engage with and fold a staple that has been sent out to the staple position, driven into a sheet bundle in a suitable position, and passed therethrough. The anvil unit 30 further comprises support arms 33 on which a fulcrum shaft 81 is pivotably supported. Plates on the left and right sides of the frame 80 are supported on and fixed to the fulcrum shaft 81, and extend toward the direction in which the cartridge 10 is installed in the staple driver 103. The anvil unit 30 also comprises a bending protrusion 34 that is engaged with the frame 80 via a pulling spring 201 that is provided in a tensioned state therebetween, and a bending protrusion 35 that is engaged with one end of a pulling spring 202 that is engaged with the joint levers 60 via a pulling spring 201 provided in a tensioned state therebetween in order to constantly urge it in a direction away from the paper tray unit 50. The anvil unit 30 also comprises a leaf spring attachment portion 36 that is attached to the paper thickness absorbing leaf spring 70, which serves to release the drive interlock of the motor MO in response to the thickness of the paper bundle and prevent damage to the device, and a bending protrusion 37 that mates with a slit hole 63 in the joint levers 60, and serves to restrict movement of the joint levers 60.

The clincher 40 is a U-shaped member that is open on the lower side thereof like the anvil unit 30, and has a clinching unit 41 that pushes down on the anvil unit 30 and bends the staple, support arms 42 that are pivotably supported by the fulcrum shaft 81 that is the same fulcrum point for anvil unit 30, and a connection shaft 43 that passes through the central portion of the anvil unit 30 and connects the joint levers 60 therewith.

The paper guide unit 50 is supported in its entirety by the device frame 80, and has a configuration in the front of the staple driver 103 that is generally well known. It includes a former means that first forms a straight staple into a U-shape, and a driver means that drives the staple formed into a U-shape by the former means into a sheet bundle.

Joint levers 60 connect the anvil unit 30 with the clincher 40 via the paper thickness absorbing leaf spring 70. Because they receive the rotation force of the motor MO and pivot the anvil unit 30 and the clincher 40, they have connection arms 61 that are rotatably supported on connection shaft 43 on the clincher 40 that extend upward, bending protrusions 62 that engage with the anvil unit 30 via pulling springs 202 provided therebetween in a tensioned state, slit holes 63 that mate with the bending protrusions 37 on the anvil unit 30 in order to restrict the position of the anvil unit 30, and slit holes 64 that receive the rotational force of the motor MO, and mate with a pivot shaft 203 in order to pivot the anvil unit 30 and the clincher 40.

When the anvil unit 30 that is pivoted by the joint levers 60 pushes down on a sheet bundle and reaches the point where it cannot pivot any further, the paper thickness absorbing leaf spring 70 is a spring for so-called paper thickness absorption which serves to block any further pivot connection. It comprises a leaf spring having a plurality of leaves for suitably adjusting the spring pressure, is open on one end thereof, and is attached to a leaf spring attachment portion 36 on the anvil unit 30.

As shown in FIG. 5, the main body frame 80 is U-shaped and open at the top such that it contains the cartridge 10, the cartridge holder 20, the anvil unit 30, the clincher 40, and the paper guide unit 50 on both sides thereof. It also supports the paper guide unit 50 on the staple driver 103 side, and supports the stapler drive mechanism disposed in the rear thereof as shown in FIG. 12. In addition, it supports an auxiliary frame 85 attached thereto and formed from a die. The auxiliary frame 85 has a cam groove 86, and shafts 87, 88, and supports a cartridge lock mechanism, a detection sensor that is used both to detect cartridge installation and when the staples have been exhausted, and the like.

The set lever 90 is a member that is formed into an approximate U-shape and interposed between the cartridge 10 such that it holds the cartridge 10 from the rear. As described earlier in FIG. 2, it can detach the cartridge 10 and the cartridge holder 20, and moreover supports and constantly urges the cartridge 10 and the cartridge holder 20 toward the staple driver 103. As shown in FIG. 11, cartridge lock mechanism that includes the set lever 90 is supported by the auxiliary frame 85. The set lever 90 has a lock release knob 91 that is manually pushed in and downward when the cartridge 10 is removed, a slit hole 92 that is arranged so that the set lever 90 can pivot forward and backward when the lock is released, a lock pin shaft 93 that moves in the cam groove 86 of the auxiliary frame 85 between a retain position that locks the cartridge 10 and a retract position that allows the cartridge 10 to be removed, a lock pawl 94 that engages the guide protrusions 11 on the cartridge 10, and a protrusion 95 for detecting arm withdrawal that, in the release position, withdraws and retains a detection arm SE2 on a no staples/cartridge installation detection sensor SE. In addition, the set lever 90 has a interlock lever 96 that pivots in response to the set lever 90 in the clockwise direction by moving a set lever 90 that is in the locked, retain position to the retract position when the cartridge 10 is removed. Further, the lock pin shaft 93 is pivotably supported so that it constantly abuts the cam groove 86 in the auxiliary frame 85 by means of an urging means 205 that comprises a pulling coil spring member. Note that because the interlock lever 96 moves the set lever 90 from the retract position to the retain position in response to the installation of the cartridge 10, the shaft 84 on the main body frame 80 is rotatably supported, and the set lever further includes a contact arm 97 that abuts guide protrusions 11 on the cartridge 10 during cartridge installation on one end thereof, and a lock release arm 98 that moves the lock pin shaft 93 on the set lever 90 to the lock release position from the locked position on the other end thereof.

Motor MO is a drive source that bends staples in a stapler into U-shapes in one continuous process, drives the staples into sheet bundles, and bends the staples driven therein. It decelerates the rotations of a standard DC motor, and drives each element by controlling the cam means with this rotation.

The connector base CO connects an external control circuit with the motor MO, and a home position sensor (not shown in the figures).

As shown in FIG. 11, the no staples/cartridge installation detection sensor. SE is pivotably supported by the shaft 88 on the auxiliary frame 85. The detection arm SE2 that extends to one side due to urging spring SE1 is urged to the position illustrated in the figure, in which it is able to detect whether or not the staples have been exhausted and whether or not a cartridge has been installed. A sensor detection protrusion SE3 on the other side thereof works together with a detection sensor not shown in the figures, and is able to detect whether or not the staples have been exhausted and whether or not a cartridge has been installed by detecting an ON/OFF state. Further, a protrusion SE4 in the area around the rotational shaft is pressed downward by means of the protrusion 95 on the set lever 90 in order to retain the set lever 90 in the retract position during removal of the cartridge 10. Note that the state in the figure shows the detection of staples replenished in the cartridge or a cartridge having staples when mounting a cartridge and the detection arm SE2 in a state of touching a staple.

Figure 13:
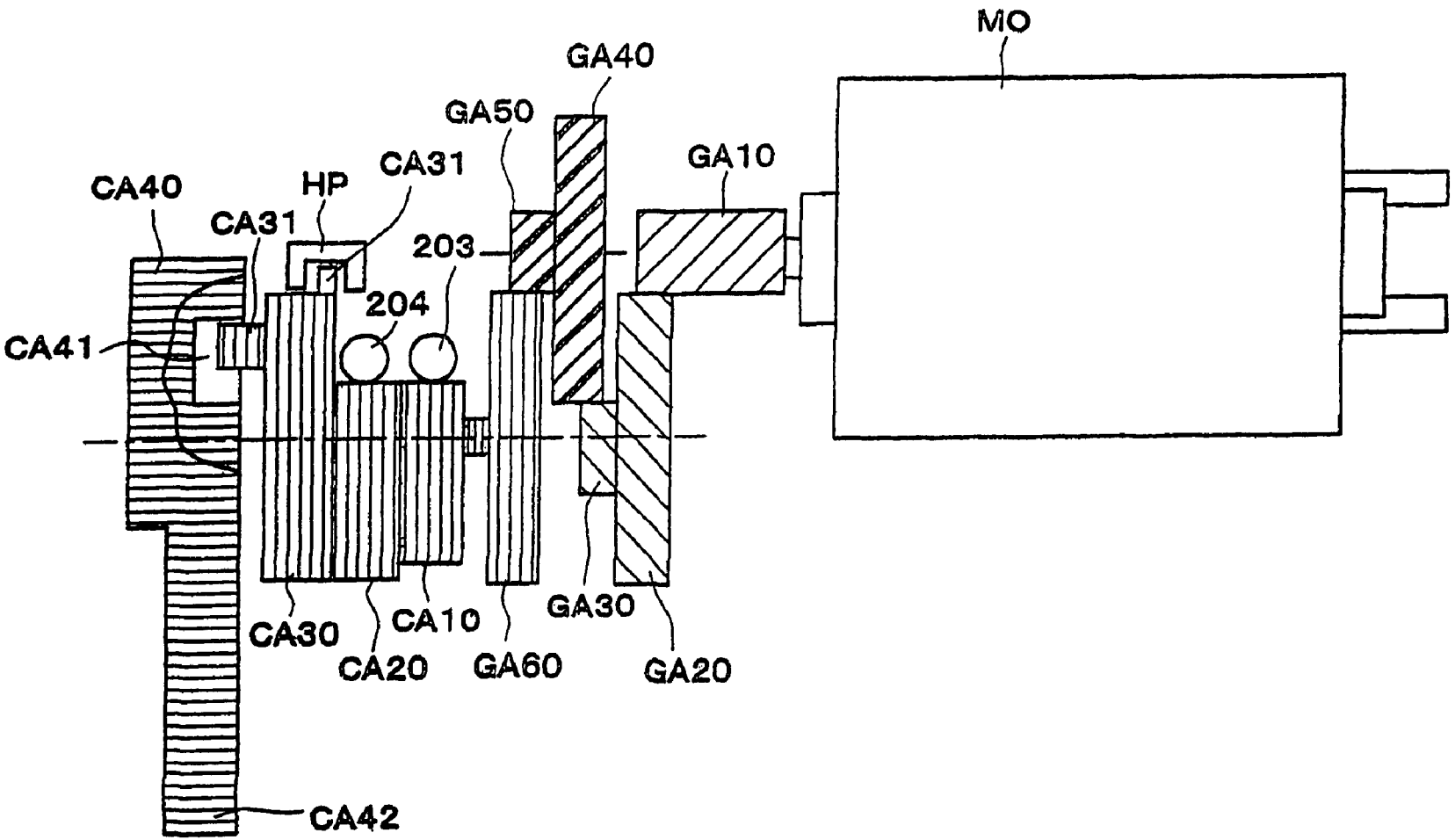
FIG. 13 is a schematic view that describes the driver drive system of the same stapler device.

As shown in FIG. 13, stapler home position detection sensor HP is comprised of a detection sensor protrusion CA31 that is established in a suitable position overlooking an initial position on the circumferential surface of a driver cam rotor CA30 that rotates by means of the motor MO, and an optical detection sensor that is disposed in a suitable position on the stapler device main body 100.

Figure 8:
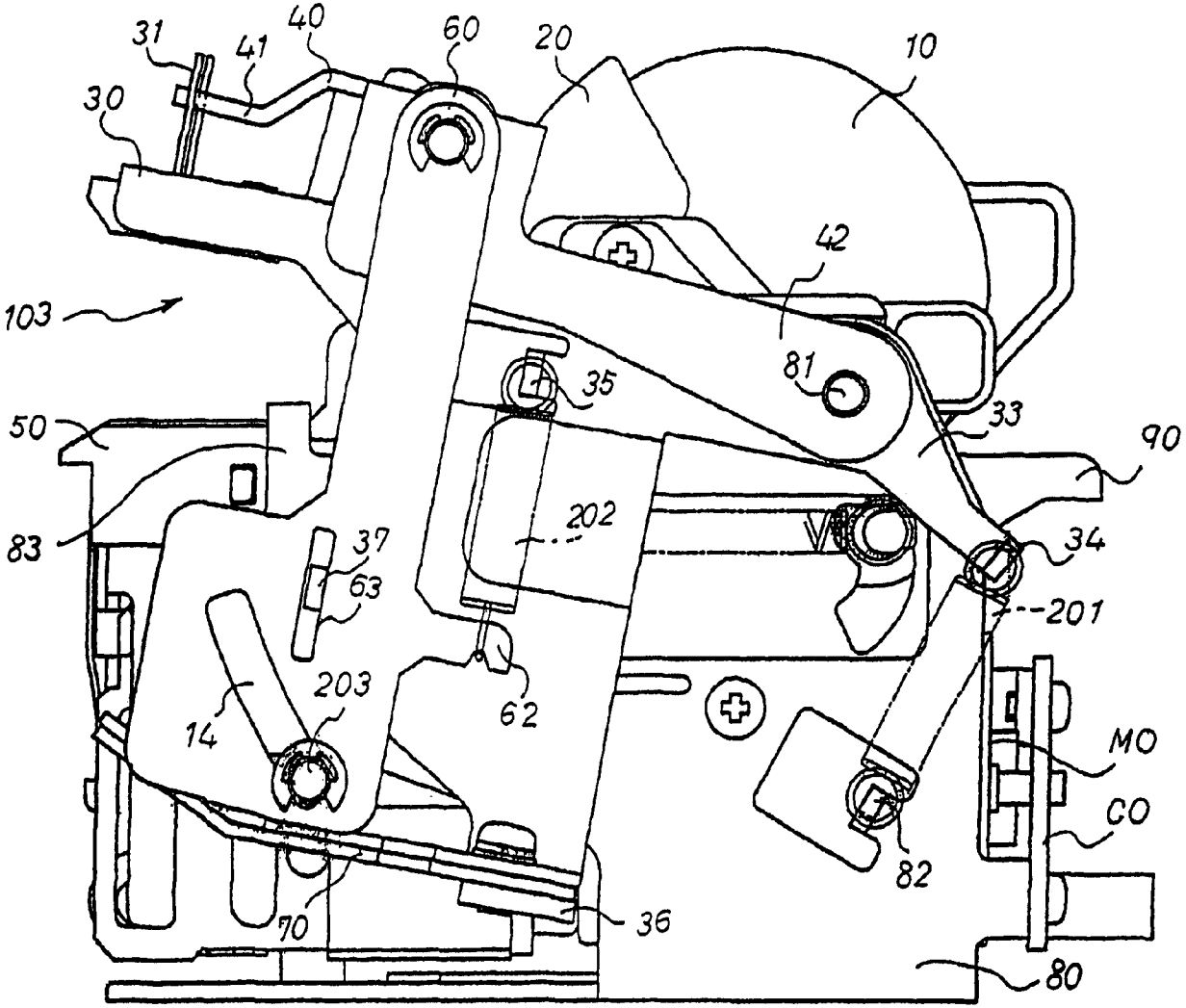
FIG. 8 is a lateral view of the same stapler device in the clincher standby state.

FIG. 8 is a lateral view of the clincher 30 of the same stapler device in a clincher standby state. This position can always be detected by the home position sensor (not previously shown in the figures), and is a state in which stapling can occur after a stapling operation has been completed, after a jam has been cleared, or the like. A large opening is opened in staple driver 103, and is in a standby state such that a sheet bundle can be inserted therein.

Figure 9:
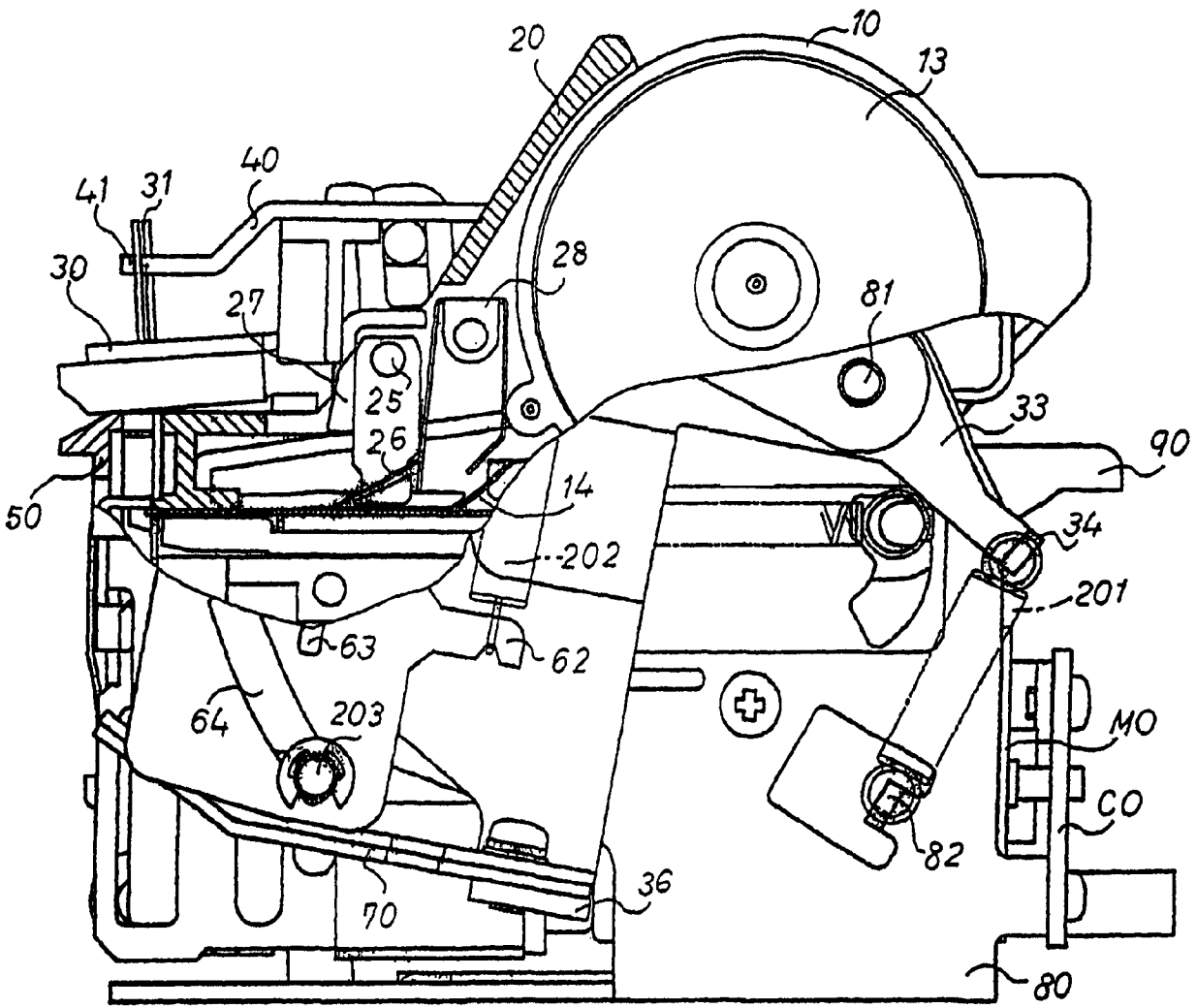
FIG. 9 is a lateral view of the same stapler device in the clincher sheet grasping state.

FIG. 9 is a lateral view of the clincher 30 of the same stapler device in a sheet grasping state, and is shown in a state in which there are no sheets grasped therein in order to describe the maximum pivot limitation. In a real stapling operation, first the pivot of the anvil unit 30 is stopped within this pivot range due to the thickness of the sheet bundle, then clincher 40 pivots further and pivots the clincher arm 31.

Figure 10:
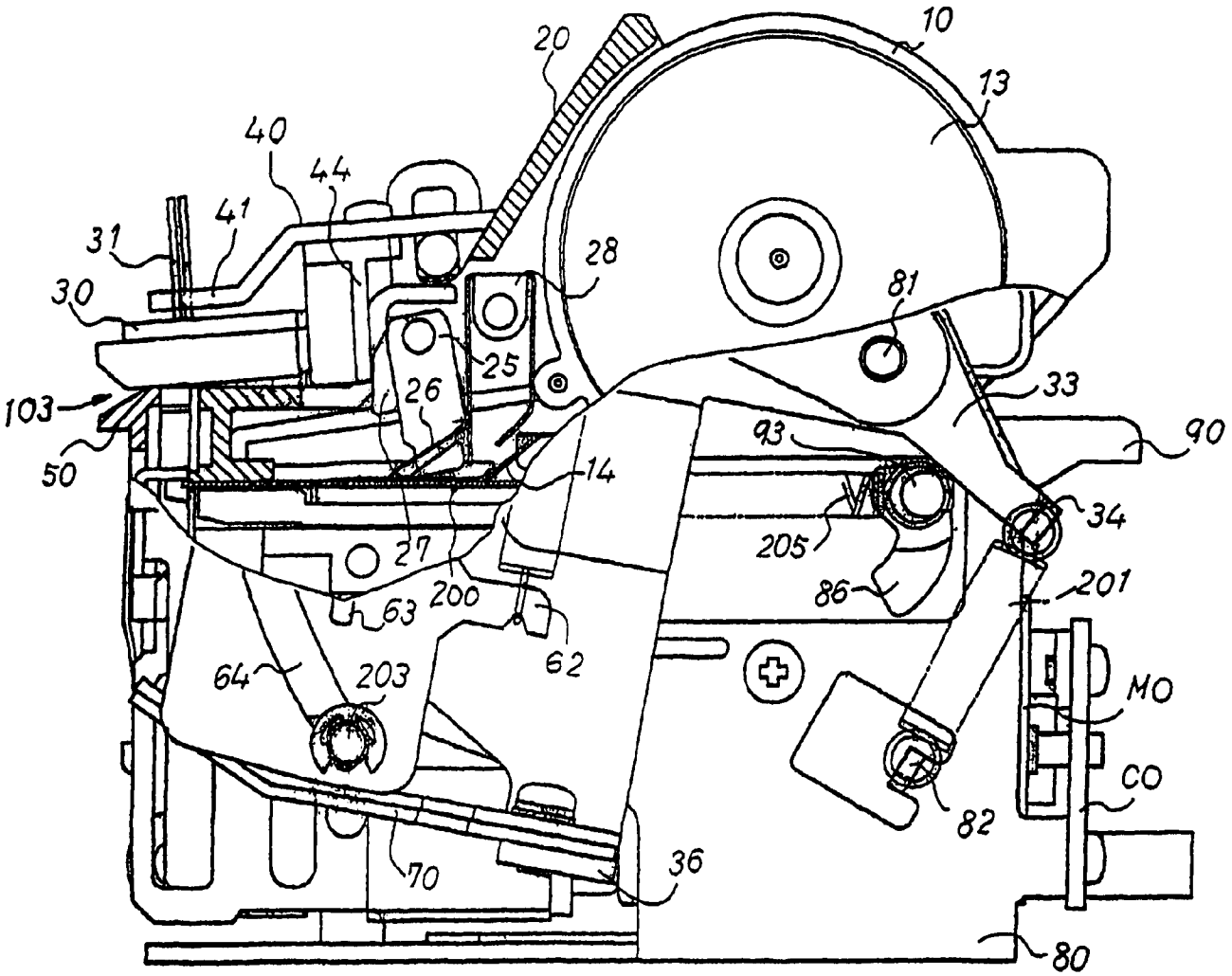
FIG. 10 is a lateral view of the same stapler device in the clincher clinch completion state.

FIG. 10 is a lateral view of the clincher 30 of the same stapler device in a clinching completed state. In the state shown in FIG. 9, the clincher arm 31 pivots further, bends the tips of the staples, engages with the engaging portion 27 of the staple forwarding pawl 25 that is formed on the clincher arm 31, and the staple forwarding pawl 25 resists and is charged by the urging force of the step pressing spring 28. In this case, even if the staple reverse prevention pawl 14 does not engage with a staple and the staple connecting portion, and the staple returns half-way back, the staple has already been driven into the sheet bundle so jams do not occur when a staple returns half-way back or there is mis-positioning of the engaging position with the driver when driving a staple.

FIG. 11 is a partial cross-sectional view of the necessary components that describe the state in which the set lever 90 of the same stapler device locks the cartridge 10, and shows a partial cross-sectional view of the necessary components of a lock mechanism for the cartridge 10 used when the cartridge 10 is installed in the stapler device main body 100. The figure shows the cartridge 10 in the installed state, and locked and retained in the stapler device main body 100, set lever 90 is urged in the direction of the staple driver 103 by the urging means 205 that comprises a coil spring of a pulling spring member that is stretched between the shaft 87 on the auxiliary frame 85 and the lock pin shaft 93 on the set lever 90. The lock pawl 94 on the set lever 90 engages with the guide protrusions 11 on the cartridge 10, and urge them toward the staple driver 103. In the figure, gaps are provided between the slit hole 92 on the set lever 90 and the shaft 87 on the auxiliary frame 85, and between the cam groove 86 in the auxiliary frame 85 and the lock pin shaft 93 on the set lever 90, so that the set lever 90 can move further in the direction of the staple driver 103. These gaps enable the set lever to retain and to lock the cartridge 10 in the retaining position without eliminate looseness at all times. Note that there are two urging means 205, each comprised of a coil spring, with one provided in a tensioned state in the same position on the opposite side of FIG. 11.

FIG. 12 is a partial cross-sectional view of the necessary components that describe the state in which the set lever 90 of the same stapler device releases the lock on the cartridge 10. In the state shown in FIG. 11, when a staple is jammed between the staple device main body 100 and the cartridge holder 20, or due to a staple replenishment signal to the user by means of a signal from the no staples/cartridge installation detection sensor SE, first, while the lock release knob 91 on the set lever 90 is pulled out to the nip side around the shaft 87 on the auxiliary frame 85 by the slit hole 92, it resists the urging means 205 and the lock pin shaft 93 lowers along the cam groove 86 on the auxiliary frame 85 and to be retained in the state of the figure. In this state, the lock pin shaft 93 touches the engaging arm 98 on the interlock lever 96 that releases the set lever to pivot clockwise in resistance to the urging means, not shown in the drawing. The lock release arm 97 established on one end of the interlock lever 96 to release the set lever faces the position to engage the guide protrusions on the upper cartridge 10, as can be seen in the figure, and the lock release arm 97 pushes the cartridge 10 to the outside of the device. The cartridge is then pulled further out to replenish staples. In this state, the cartridge 10 having been replenished with staples is inserted into the stapler device main body 100 thereby the cartridge 10 guide protrusions 11 touch the lock release arm 97 to push the lock release arm 97 counter-clockwise thereby the engaging arm 98 on the lock release arm 97 pushes the lock pin shaft 93 on the set lever 90 upward. The lock pin shaft faces 98 the retaining position to lock along the cam groove 86 on the auxiliary frame 85, indicated in FIG. 11. At this time, the guide protrusion 11 on the cartridge 10 is at the position passing the engaging arm 98 and the guide protrusion 11 engages from behind by the engaging arm 98. The urging means 205 constantly urges toward the staple position direction to make the locked state shown in FIG. 11. Note that in the locked state, the cartridge 10 is constantly urged to the staple position direction to correctly position the end of the staples always on the staple driving position on the staple driver 103 so that the end of the staple 200 is retained at the staple end 12 and it is impossible for staples to be unnecessarily taken out.

FIG, 13 is a schematic view that describes the driver drive system of the same stapler device, It is composed of the drive motor MO that is comprised of a direct current motor, an output gear GA10, first and second reduction gears GA20 and GA30, third and fourth reduction gears GA40 and GA50, a fifth reduction gear GA60, a clincher drive eccentric cam CA10, an anvil drive eccentric cam CA20, a driver cam rotor CA30 that forms an engagement pin CA31, and a driver drive eccentric cam CA40 that forms the driver drive cam surface CA42 and the indentation mated by the engaging pin CA31, The pivot shaft 203 that pivots the clincher 40 abuts the clincher drive eccentric cam CA10, and the pivot shaft 204 that pivots the anvil unit 30 abuts the anvil drive eccentric cam CA20, In addition, the detection protrusion CA31 that detects the home position is configured to interrupt light at the home position to control the optical detection sensor HP established at the appropriate position on the stapler device main unit 100 in one rotation.

Figure 14:
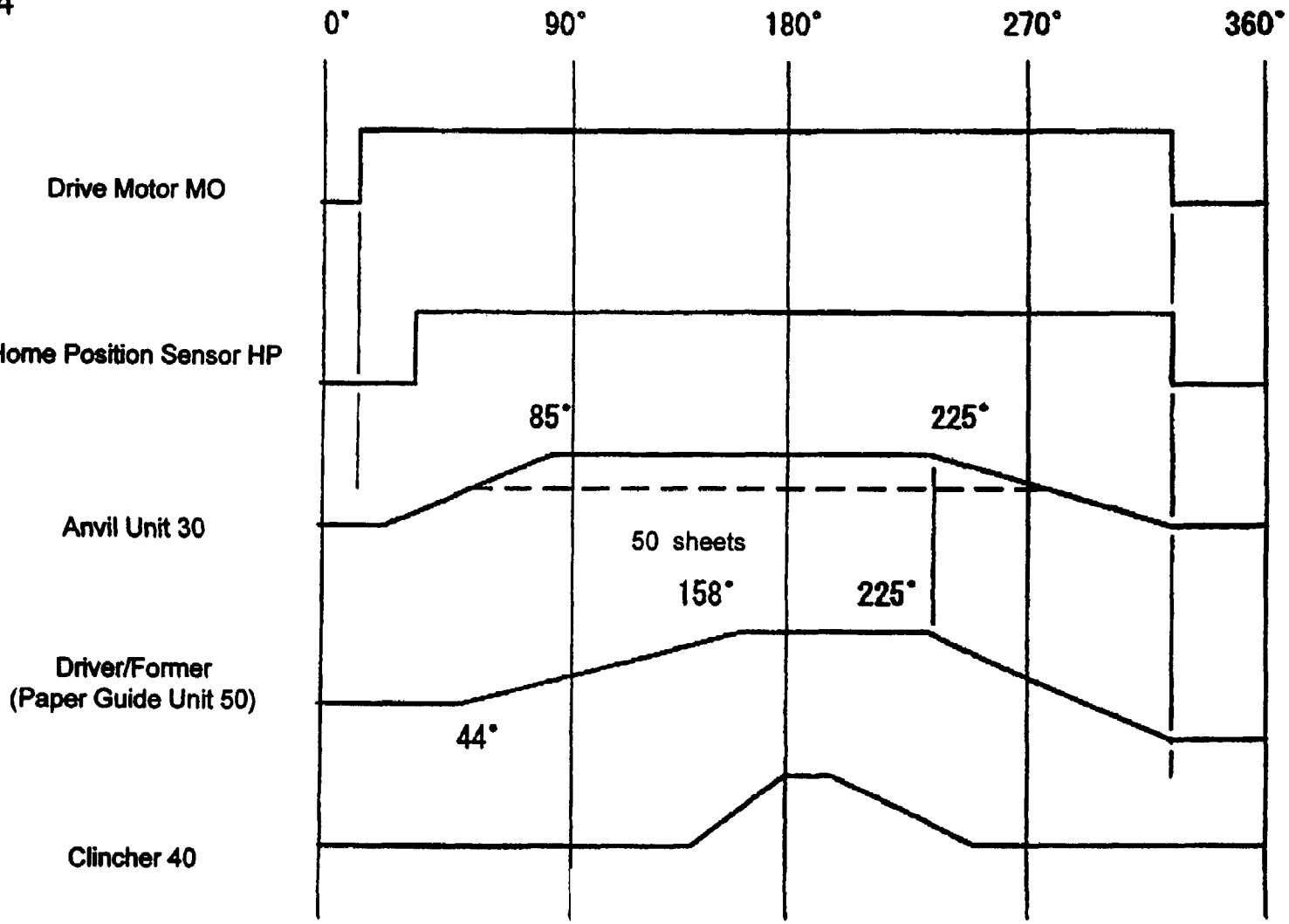
FIG. 14 is a timing chart that describes the serial operation of the same stapler device.

FIG. 14 is a timing chart that describes the serial operation of the same stapler device. This serial operation will be described by using this FIG. 14, the drive system of FIG. 13, and FIGS. 8 to 10. Drive motor MO receives a staple operation start signal from the device main body (not shown in the figures) and begins to rotate. As shown in FIG. 13, the output gear GA10 receives the rotation of the drive motor MO, and the sixth reduction gear 60 starts to rotate via the first through fifth rotation gears, 10–50. The movement of this sixth reduction gear 60 corresponds to the movement of the drive motor MO of FIG. 14. First, the anvil pivot shaft 203 that abuts the anvil drive eccentric cam CA20 starts the pivoting of anvil unit 30 to pivot within a range of a maximum of 2 sheets in a plurality sheets in a sheet bundle to be sandwiched (rotational angle 85° of the sixth reduction gear 60) 50 sheets which is the tolerable number of sheets in a bundle, indicated by the dotted line in the figure. When doing so, the anvil unit 30 sandwiches the sheet bundle and cannot swing farther so the swinging of anvil pivot shaft 203 that abuts the anvil drive eccentric cam CA20 is absorbed by the paper thickness absorbing leaf spring 70. The former and driver, not shown in the figures and driven by the driver drive cam CA40 shown in FIG. 1 is slidably supported in the vertical direction in the paper guide unit 50 moves slightly later than the pivoting of the anvil unit 30 and after the former has formed the straight staple ends into a U-shape, the driver continues to drive the staple ends formed into a U-shape into the sheet bundle an appropriate amount. Then, the pivot shaft 203 that abuts the clincher drive eccentric cam CA10 starts the pivoting of the clincher 40 to bend the ends of the staples driven into and having pierced through the sheet bundle an appropriate amount. After bending, the clincher 40 returns and anvil unit 30 and the driver and former return to complete one series of the stapling operation. Note that after starting the rotation of the drive motor MO, the home position sensor HP slightly later because of the rotation of the driver cam rotating body CA30 detects that the stapler device 100 is not in the home state or the prescribed initial state. By detecting whether or not it has returned to its initial state in the prescribed time, it checks to confirm the series of the stapler's operations and in the event that the home position sensor HP output after the prescribed operations is not recovered to its initial state, an error is determined for handling. Note, that although the starting of the operation is slightly delayed, in reference to the action of the drive motor MO, it is also possible to detect simultaneously.

What is claimed is:

1. In a staple storage unit comprising a storage portion that stores staples and a guide portion that guides staples in the storage portion to a staple driver having a first side facing the staples being delivered from the staple storage unit, the storage unit being detachable from a stapler device frame, the staple storage unit comprising:

a staple attracting material on the guide portion and positioned to be adjacent the first side of the staple driver when the staple storage unit is attached to the stapler, the staple attracting material operable to facilitate removal of staples jammed in or near a staple driving position upon detachment of the staple storage unit from the stapler.

2. The staple storage unit according to claim 1, wherein said staple attracting material is comprised of an adhesive material.

3. The staple storage unit according to claim 1, wherein said staple attracting material is comprised of a magnet material.

4. In a staple storage unit comprising a storage portion that stores staples and a guide portion that guides staples in the storage portion to a staple driver having a driver means capable of reciprocating to drive the staples, the staple driver further having a first side facing the staples being delivered from the staple storage unit, the storage unit being detachable from a stapler device frame, said staple storage unit comprising:

a guide surface that forms at least one portion of the staple storage unit and is adapted to be positioned adjacent the first side of said staple driver to guide the movement of staples to be driven by said driver means, and a magnetic material disposed on the guide surface to facilitate removal of staples jammed in or near a staple driving position upon detachment of the staple storage unit from the stapler.

5. The staple storage unit according to claim 4, wherein said guide surface is formed from a non-magnetic material that covers the magnetic material.

6. The staple storage unit according to claim 4, wherein said magnetic material is disposed in a crown movement area of a staple to be driven by the driver means.

7. The staple storage unit according to claim 4, wherein said staple storage unit is formed from a cartridge that stores staples and a cartridge holder that detachably supports the cartridge.

8. In a stapler device that detachably supports a staple storage unit having a storage portion that stores staples and a guide portion that guides staples in the storage portion to a staple driver having a first side facing the staples being delivered from the staple storage unit, the stapler device staple drive unit comprising:

a staple attracting material on the guide portion and positioned to be adjacent the first side of the staple driver when the staple storage unit is attached to the stapler, the staple attracting material operable to facilitate removal of staples jammed in or near a staple driving position upon detachment of the staple storage unit from the stapler.

9. The stapler device according to claim 8, wherein said staple attracting material is composed of a magnetic material.

* * * * *